US008018316B2

(12) United States Patent
Pardo et al.

(10) Patent No.: US 8,018,316 B2
(45) Date of Patent: Sep. 13, 2011

(54) ELECTROLESS PLATING PRODUCTION OF NICKEL AND COBALT STRUCTURES

(75) Inventors: Flavio Pardo, New Providence, NJ (US); Maria E. Simon, New Providence, NJ (US); Brijesh Vyas, Warren, NJ (US); Chen Xu, New Providence, NJ (US)

(73) Assignee: Alcatel Lucent, Paris (FR)

( * ) Notice: Subject to any disclaimer, the term of this patent is extended or adjusted under 35 U.S.C. 154(b) by 660 days.

(21) Appl. No.: 11/747,555

(22) Filed: May 11, 2007

(65) Prior Publication Data

US 2008/0278029 A1 Nov. 13, 2008

(51) Int. Cl.
*H01H 71/18* (2006.01)
*H01H 61/00* (2006.01)

(52) U.S. Cl. ..... 337/123; 337/132; 337/139; 337/141

(58) Field of Classification Search ..... 337/14, 337/111, 123, 132, 139, 141
See application file for complete search history.

(56) References Cited

U.S. PATENT DOCUMENTS 4,714,804 A * 12/1987 Yasuda et al. ..... 200/11 DA
6,367,252 B1 * 4/2002 Hill et al. ..... 60/528
6,407,478 B1 6/2002 Wood et al.
7,036,312 B2 5/2006 Menard et al.
7,471,184 B1 * 12/2008 Aksyuk et al. ..... 337/1
2002/0047172 A1 * 4/2002 Reid ..... 257/415
2002/0118472 A1 * 8/2002 Hill ..... 359/872
2005/0173374 A1 * 8/2005 Cohen et al. ..... 216/41

FOREIGN PATENT DOCUMENTS

DE 3742594 A * 6/1989

OTHER PUBLICATIONS

Shen, et al., "Synthesis and Characterization of Ni-P-CNT's Nanocomposite Film for MEMS Applications", IEEE Transactions on Nanotechnology, vol. 4, No. 5, Sep. 2005, pp. 539-547.
Takashima, et al., "Fatigue and fracture of a Ni-P amorphous alloy thin film on the micrometer scale", 2005 Blackwell Publishing Ltd. Fatigue Fract Engng Mater Struc 28, pp. 703-710.
Teh, et al., "Nickel Nano-Composite Film for MEMS Applications", The 12th International Confernece on Solid State Sensors, Actuators and Microsystems, Boston, Jun. 8-12, 2003, pp. 1534-1537.
Yi, et al., "Electroless Nickel Films: Properties and Fabricated Cavity Structure", Journal of Micromechanical Systems, vol. 11, No. 4 Aug. 2002, pp. 293-301.
Agrawal, et al., "A Latching MEMS Relay for DC and RF Applications", Jan. 2004, IEEE, pp. 222-225.
Flechon, J, et al.; "Magnetization of an electroless deposited nickel-phosphorus alloy"; J. Physique 46 (1985); pp. 14-5-1409.
Cargill, G. S., III; "Structural Investigation of Noncrystalline Nickel-Phosphorus Alloys"; Journal of Applied Physics, vol. 41, No. 1, Jan. 1970; pp. 12-29.

* cited by examiner

*Primary Examiner* — Anatoly Vortman
(74) *Attorney, Agent, or Firm* — Hitt Gaines, PC

(57) ABSTRACT

A method comprising forming a structural element 115 on a surface 620 of a layer 510 via an electroless plating of nickel or cobalt 130 onto the surface, the layer being rigidly fixed to an underlying substrate 110. The method also comprises etching away a portion of the layer such that a part of the structural element is able to move with respect to the substrate.

12 Claims, 12 Drawing Sheets

ELECTROLESS PLATING PRODUCTION OF NICKEL AND COBALT STRUCTURES

TECHNICAL FIELD OF THE INVENTION

The present invention relates, in general, to microelectromechanical system (MEMS) devices, as well as methods of using and manufacturing such devices.

BACKGROUND OF THE INVENTION

Silicon (e.g., polysilicon) is one of the most widely-used structural materials for MEMS devices. In addition to having well-established silicon fabrication technologies for microelectronic processing, silicon has mechanical properties that are desirable in applications requiring the precise movement of MEMS components. E.g., silicon-based MEMS components are able to tolerate repeated high stresses to near silicon's ultimate tensile strength without being irreversibly deformed. The electrical properties of silicon, however, are less ideal in applications where components having a low electrical resistivity and a high coefficient of thermal expansion (CTE) are desired.

SUMMARY OF THE INVENTION

To address one or more of the above-discussed deficiencies, one embodiment of the present invention is a method of manufacture. The method comprises forming a structural element on a surface of a layer via an electroless plating of nickel or cobalt onto the surface, the layer being rigidly fixed to an underlying substrate. The method also comprises etching away a portion of the layer such that a part of the structural element is able to move with respect to the substrate.

Another embodiment is an apparatus that comprises a substrate having a surface and a microelectromechanical device. The microelectromechanical device includes a structural element having a first part that is rigidly fixed to the substrate surface. The structural element also has a second part that is movable with respect to the substrate. The structural element includes nickel or cobalt alloyed with phosphorus or boron.

Another embodiment is a method of use comprising actuating a microelectromechanical thermal actuator device. Actuating the device includes applying a current to a structural element of the device. The structural element includes electrolessly plated nickel or cobalt alloyed with phosphorus or boron. The structural element has first and second parts. The first part is rigidly fixed to the substrate. The applied current causes the second part to move.

BRIEF DESCRIPTION OF THE DRAWINGS

Various embodiments are understood from the following detailed description, when read with the accompanying figures. Various features may not be drawn to scale and may be arbitrarily increased or reduced in size for clarity of discussion. Reference is now made to the following descriptions taken in conjunction with the accompanying drawings, in which.

DETAILED DESCRIPTION

Nickel or cobalt and their alloys have been considered as a replacement material for silicon for MEMS device applications, but were found to be inadequate in some characteristics. Unlike polysilicon, electroplated nickel or cobalt is prone to yield point or creep deformations at stresses that are considerably lower than its ultimate tensile strength. Consequently, movable components made of electroplated nickel or cobalt are more likely to suffer fatigue and fail earlier than their silicon counterparts. This can reduce the reliability of certain MEMS devices that require its components to make precise repetitive movements throughout the device's lifetime. Additionally, further steps are required to form electroplated nickel or cobalt components as compared to when working with silicon. E.g., an electrode has to be contacted to a component being electroplated, and a current must be passed through the component to drive electroplating. These steps can add to the cost and complexity of MEMS device fabrication.

The electroless nickel or cobalt plated structures of the present invention are a new result-effective variable that provides several physical property and fabrication process advantages over silicon or electroplated nickel structures. The electroless nickel or cobalt plated structures have higher yield points and less creep deformation as compared to electroplated nickel or cobalt. Their electrical conductivity and thermal expansivity are greater than polysilicon. Because an electroless plating method is used, the additional fabrication process complexities associated with the electroplating of nickel or cobalt structures are avoided. The electrolessly nickel or cobalt plated structures can be formed at much lower temperatures than used to deposit and anneal polysilicon, thereby mitigating thermal damage to temperature-sensitive components of a MEMS device.

These features benefit the fabrication of movable electrically conductive nickel or cobalt-containing structural elements in MEMS devices. Although the example devices and methods presented below feature MEMS devices configured as, or including, a thermal actuator, other types of MEMS devices having other types of components, such as electrostatic actuators, could be constructed with the structural elements and by the methods described herein.

Figure 1:
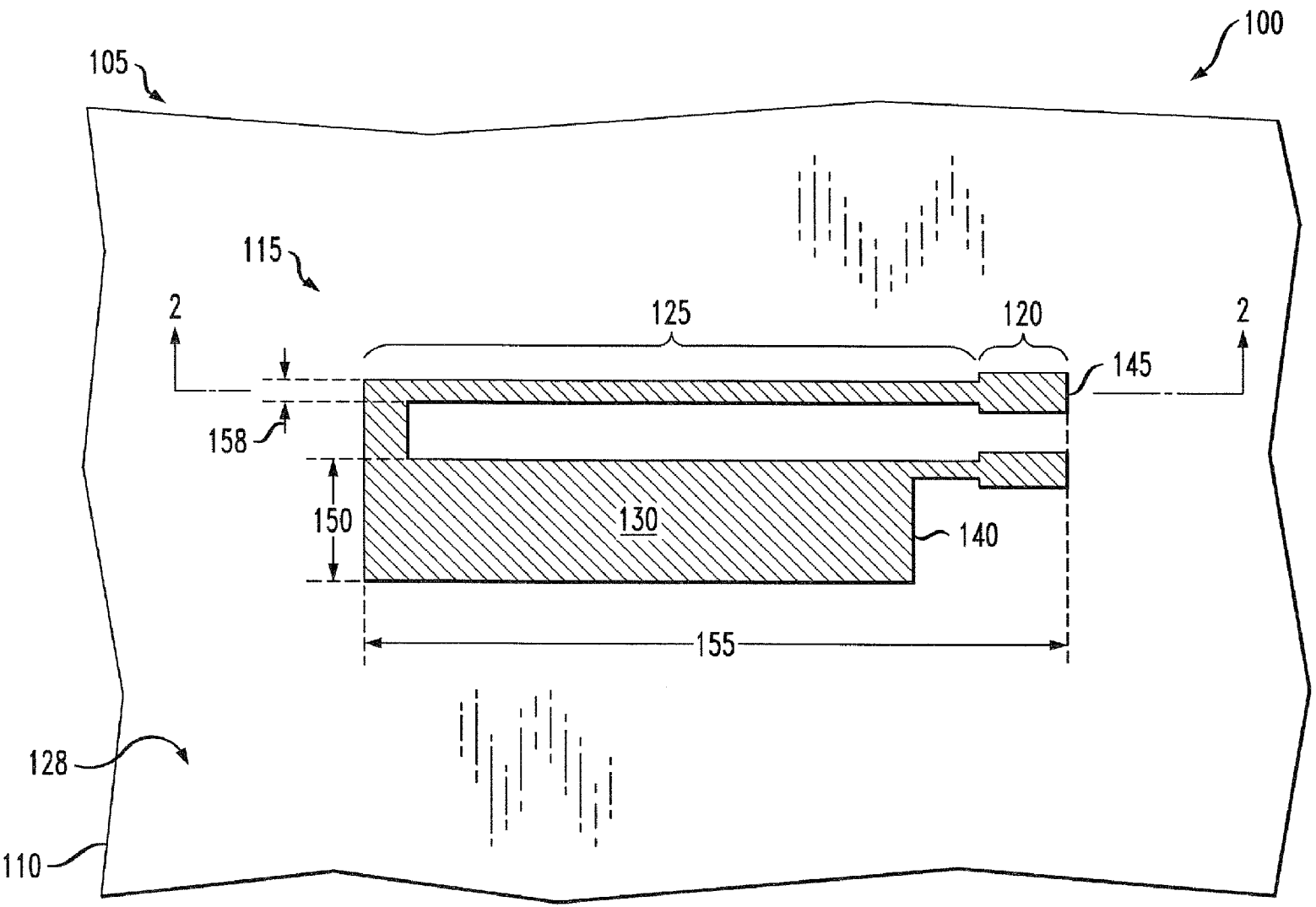
FIG. 1 presents a plan view of an example embodiment of an apparatus of the invention.
Figure 2:
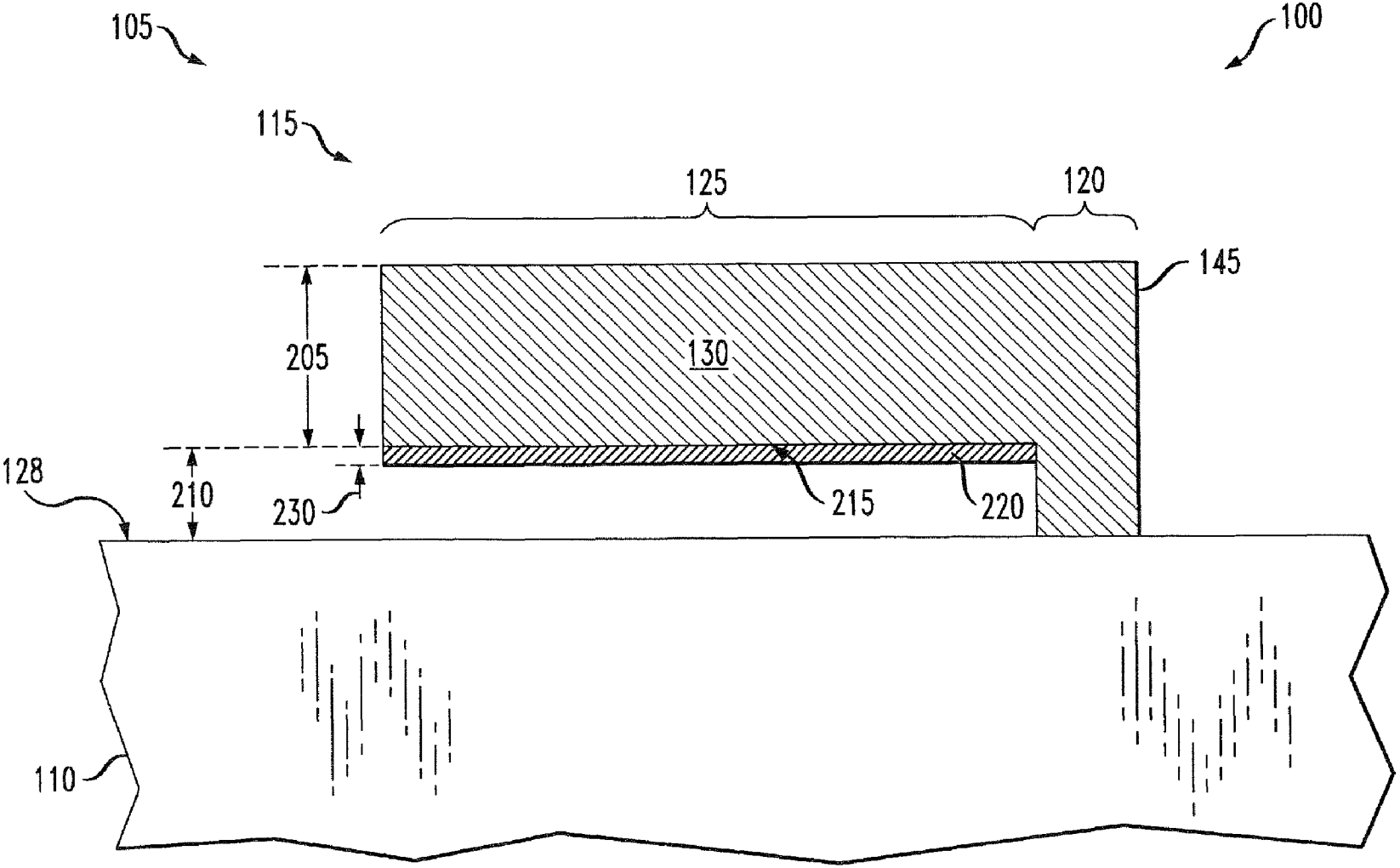
FIG. 2 presents a cross-sectional view of the apparatus shown in FIG. 1.

FIG. 1 presents a plan view of an example embodiment of an apparatus 100 of the invention. FIG. 2 presents a cross-sectional view of the apparatus along view line 2-2 (FIG. 1). The apparatus 100 comprises a MEMS device 105 and a substrate 110. The MEMS device 105 includes a structural element 115 having a first part 120 and a second part 125. The first part 120 of the MEMS device 105 is rigidly fixed to a surface 128 (e.g., a planar surface) of the substrate 110. The second part 125 of the MEMS device 105 is movable with respect to the substrate 110.

The structural element 115 includes nickel or cobalt alloyed with phosphorus or boron, termed herein as an electroless alloy 130. Example electroless alloys 130 include nickel phosphorus (Ni—P), nickel boron (Ni—B), cobalt phosphorus (Co—P) cobalt boron (Co—B) alloys, or mixtures thereof. More preferably, the electroless alloy 130 has a substantially amorphous structure. The term substantially amorphous structure as used herein refers to an electroless alloy having no discernable peaks in an x-ray powder pattern. For example, there are no discernable peaks that can be attributed to an ordered structure over a range of diffraction angles (2θ) of about 0 to 160 degrees. Some embodiments of the amorphous electroless alloy can have microcrystalline regions indicated by a broadening of the x-ray diffraction peaks. In comparison, electroplated nickel or cobalt, which typically is pure nickel or cobalt (e.g., about 99 weight percent of higher), has a substantially crystalline structure with readily discernable x-ray diffraction peaks.

The presence of the amorphous structure is important to providing the structural element 115 with a desirable combination of physical and electrical properties over that of electroplated nickel or silicon. In turn, a high phosphorus or boron content in the alloy is important to making the nickel or cobalt alloy's structure substantially amorphous. That is, the electrolessly plated Ni—P, Ni—B, Co—P, or Co—B alloys 130 have an increasingly amorphous structure with an increasing phosphorus or boron content. In some embodiments, the structural element 115 is composed of electroless alloy 130 having about 9 atomic percent (at %) or higher phosphorus or boron, because this facilitates the formation of the substantially amorphous structure. In some embodiments, the electroless alloy 130 has a phosphorous or boron content of about 16 at % or higher and in some cases, ranging from about 16 to 20 at %. Below about 16 at %, the electroless alloy 130 has increasing amounts of microcrystalline structure (e.g., at phosphorus or boron contents ranging from about 9 to 15 at %) or crystalline structure (e.g., at phosphorus or boron contents of less than about 7 at %). Above about 20 at % there can be problems with the stability of a reducing agent used as the source of phosphorus or boron. E.g., in some reducing agents that has greater then 20 at % sodium hypophosphite, the hypophosphite ions can rapidly decompose.

A structural element 115 that comprises the electroless alloy 130 can have a balance of the desirable physical, thermal and electrical properties of silicon and electroplated nickel or cobalt. For instance, the amorphous structure of the electroless alloy 130 can cause the structural element 115 to have desirable mechanical properties as compared to an analogous structural element made of electroplated nickel or cobalt. For instance, the yield point and creep point of the electroless alloy 130 are closer to its ultimate tensile strength than for electroplated nickel or cobalt. The term yield point as used herein refers to the stress load at which a structural element is irreversibly deformed. The term creep point as used herein refers to a prolonged stress load at which a structural element is irreversibly deformed. The term ultimate tensile strength as used herein refers to the stress load at which a structural element breaks. Consequently, the electroless alloy 130 provides a structural element 115 whose movement can be more reliably and precisely repeated, using higher forces, and over a longer period of time without deformation, as compared to electroplated nickel.

For comparison, consider when the yield point and ultimate tensile strength of an electroplated nickel sample equals 200 MPa and 400 MPa, respectively. In such cases, the yield point is within 50 percent of the ultimate tensile strength. In contrast, the yield point of some embodiments of the amorphous electroless Ni—P or Ni—B alloy 130 occurs at least within 55 percent of its ultimate tensile strength (about 650 to 900 MPa) E.g., consider when the creep point of an electroplated nickel sample equals 100 MPa. In such cases, the creep point is within 25 percent of the ultimate tensile strength. In contrast, the creep point of some embodiments of the amorphous electroless Ni—P alloy 130 occurs within 30 percent of its ultimate tensile strength.

Some embodiments of the electroless Ni—P or Ni—B alloy 130 have a CTE that is comparable to that of electroplated nickel (about 13 μm/m/° C.) and that is higher than that of silicon (about 2.6 μm/m/° C.). E.g., embodiments of the Ni—P alloy 130 having from about 9 to 20 at % phosphorus can have a CTE ranging from about 8 to 16 μm/m/° C. Although some embodiments of the Ni—P alloy 130 with about 9 to 20 at % phosphorus have an electrical resistivity (e.g., about 35 to 110 μΩ-cm) that is higher than electroplated nickel (about 7 μΩ-cm), its resistivity is still lower than that of silicon (about 1000 to 4000 μΩ-cm).

Embodiments of the electroless alloy 130 could further include other transition metals. E.g., in some embodiments, the electroless alloy 130 further includes W or Mo to provide a structural element 115 that is harder as compared to a structural element 115 that does not include such transition metals. In other embodiments, it is desirable for the electroless alloy 130 to include Ni and Co to provide a structural element 115 that is harder as compared to a structural element 115 that does not include both Ni and Co.

As further illustrated in FIG. 1, some embodiments of the structural element 115 include a first beam 140 and a second beam 145, where the second beam 145 is parallel to the first beam 140. The first beam 140 has at least one dimension (e.g., a width 150, a length 155, or a thickness 205 shown in FIG. 2) that is about two times or greater than a same dimension of the second beam 145. In some embodiments, the thickness 205 can range from about 5 to 50 microns and the length 155 can range from about 100 to 1000 microns. E.g., consider embodiments where the first and second beams 140, 145 have the same thickness 205 and length 155 of about 12 and about 100 microns, respectively. In such embodiments, the width 150 of the first beam 140 can equal about 12 microns and a width 158 of the second beam equals about 3 microns. Consequently, when a current is applied to the structural element 115, a current passing through the structural element 115 will heat the second beam 145 to a higher temperature than the first beam 140. As a result, the second beam 145 can be thermally expanded to a greater extent that the first beam 140, thereby causing the second part 125 of the structural element 115 to move (e.g., laterally) relative to the substrate 110.

One skilled in the art would appreciate that the direction and amount by which the second part 125 moves can be precisely controlled by, e.g., adjusting the composition, shape and dimensions of the structural element 115, as well as by adjusting the magnitude and duration of the applied current.

In some embodiments of the apparatus 100, the distance 210 between the moveable second part 125 and the substrate 110 surface 128 ranges from about 1 to 10 microns (FIG. 2) Such distances are conducive to thermally isolating the second part 125 from the substrate 110, so that heat cannot be readily dissipated to the substrate 110 when a current is applied to the structural element 115.

FIG. 2 further illustrates that for some embodiments, a surface 215 of the structural element 115 also comprises a seed layer 220 thereon. The seed layer 220 facilitates the initiation of the nickel or cobalt and phosphorus or boron electroless plating (e.g., the formation of the electroless alloy 130). Some embodiments of the seed layer 220 are deposited by sputtering a metal to a thickness 230 ranging from about 0.01 to 1 micron.

In some cases, the seed layer's 220 thickness 230 is at least about 10 times less than a thickness 205 of the structural element 115. In such embodiments, the seed layer 220 does not substantially affect the structural element's 115 mechanical or thermal properties. In other embodiments, however, the seed layer 220 is entirely removed from the structural element 115. For instance, in some embodiments, the structural element 115 consists essentially of the electroless alloy 130.

That is, in such embodiments, the structural element 115 is composed of at least about 99 wt % of the electrolessly plated Ni—P, Ni—B, Co—P or Co—B alloy 130.

Figure 3:
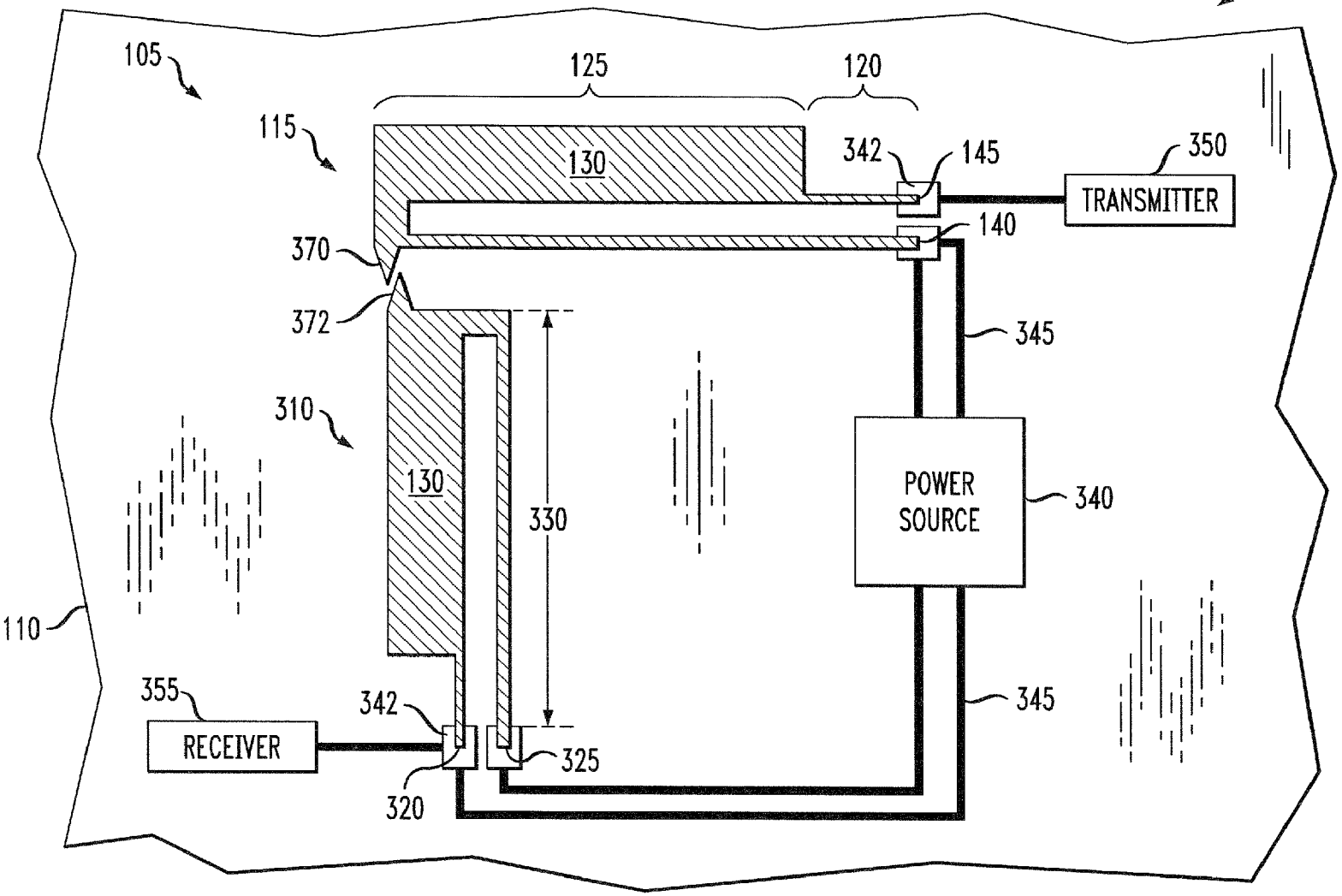
FIG. 3 presents a schematic view of an example embodiment of an apparatus of the invention.

FIG. 3 illustrates a schematic view of additional aspects of the apparatus 100 and MEMS device 105 of the invention. Similar reference numbers are used to depict similar features shown in FIG. 1. In the embodiment depicted in FIG. 3, a MEMS device 105, similar to that depicted in FIG. 1, is configured as a microelectromechanical thermal relay. The MEMS device 105 further includes a second structural element 310 on the substrate 110 and adjacent to, but electrically isolated from, the structural element 115 when the MEMS device 105 is not actuated. Similar to the structural element 115, embodiments of the second structural element 310 can include, as in some cases consist essentially of, the electroless alloy 130 having the substantially amorphous structure. The second structural element 310 can have the same or different nickel or cobalt and phosphorus or boron content as the structural element 115.

As further illustrated in FIG. 3, the second structural element 310 can comprise two parallel beams 320, 325 whose long axis (e.g., length 330) is perpendicular to a long axis (e.g., length 155 in FIG. 1) of the parallel beams 140, 145 of the structural element 115. The apparatus 100 can further include a power source 340 electrically coupled to the structural element 115 (e.g., via metal contacts 342 and lines 345 on the substrate 110), and in some cases, also electrically coupled to the second structural element 310.

The apparatus 100 can also include a transmitter 350 that is electrically coupled to the structural element 115 (e.g., via metal lines 345 and contacts 342), and a receiver 355 that is electrically coupled to the second structural element 310. The transmitter 350 is configured to transmit a signal through one or both of the structural element 115 and second structural element 310 to the receiver 355. Signal transmission occurs when the MEMS device 105 is actuated to cause one or both of the structural element 115 and second structural element 310 to move and thereby contact each other.

FIGS. 3 and 4A-4C illustrate another embodiment of the invention, a method of use. As further illustrated in FIG. 3, both the structural element 115 and second structural element 310 have projections 370, 372 that are configured to latch the structural element 115 and second structural element 310 together when one or both of these elements 115, 310 are caused to move in a pre-defined fashion.

As noted above, one or both of the structural element 115 or second structural element 310 include the electrolessly plated nickel or cobalt alloyed with phosphorus or boron (e.g., the electroless alloy 130). Consequently, the MEMS device 105 can be actuated a plurality of times, or held in a stressed configuration for prolonged period, without having these elements 115, 310 irreversibly deformed.

Figure 4A:
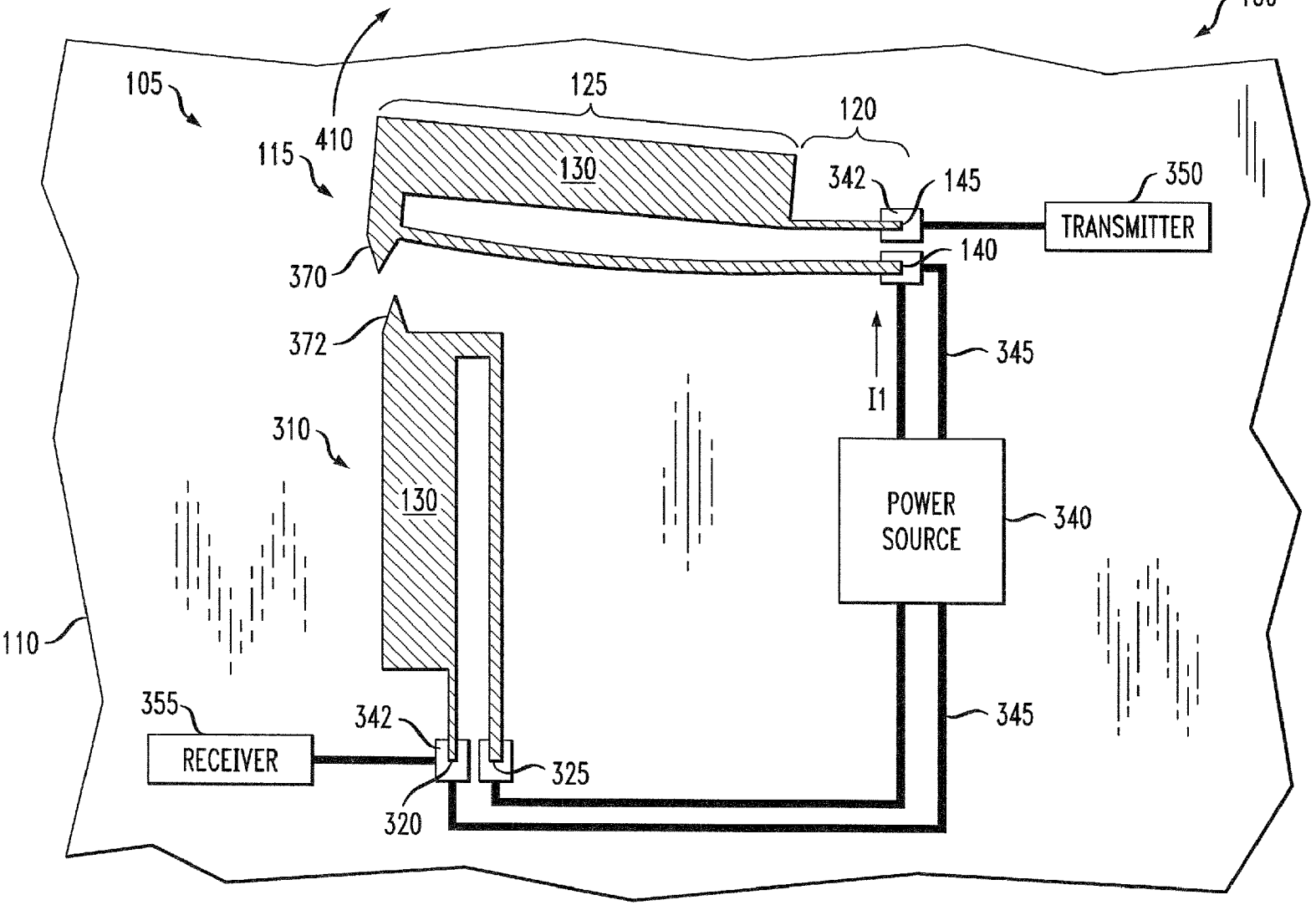
FIGS. 4A-4C present schematic views of an example embodiment of an apparatus at a selected stage of use.
Figure 4B:
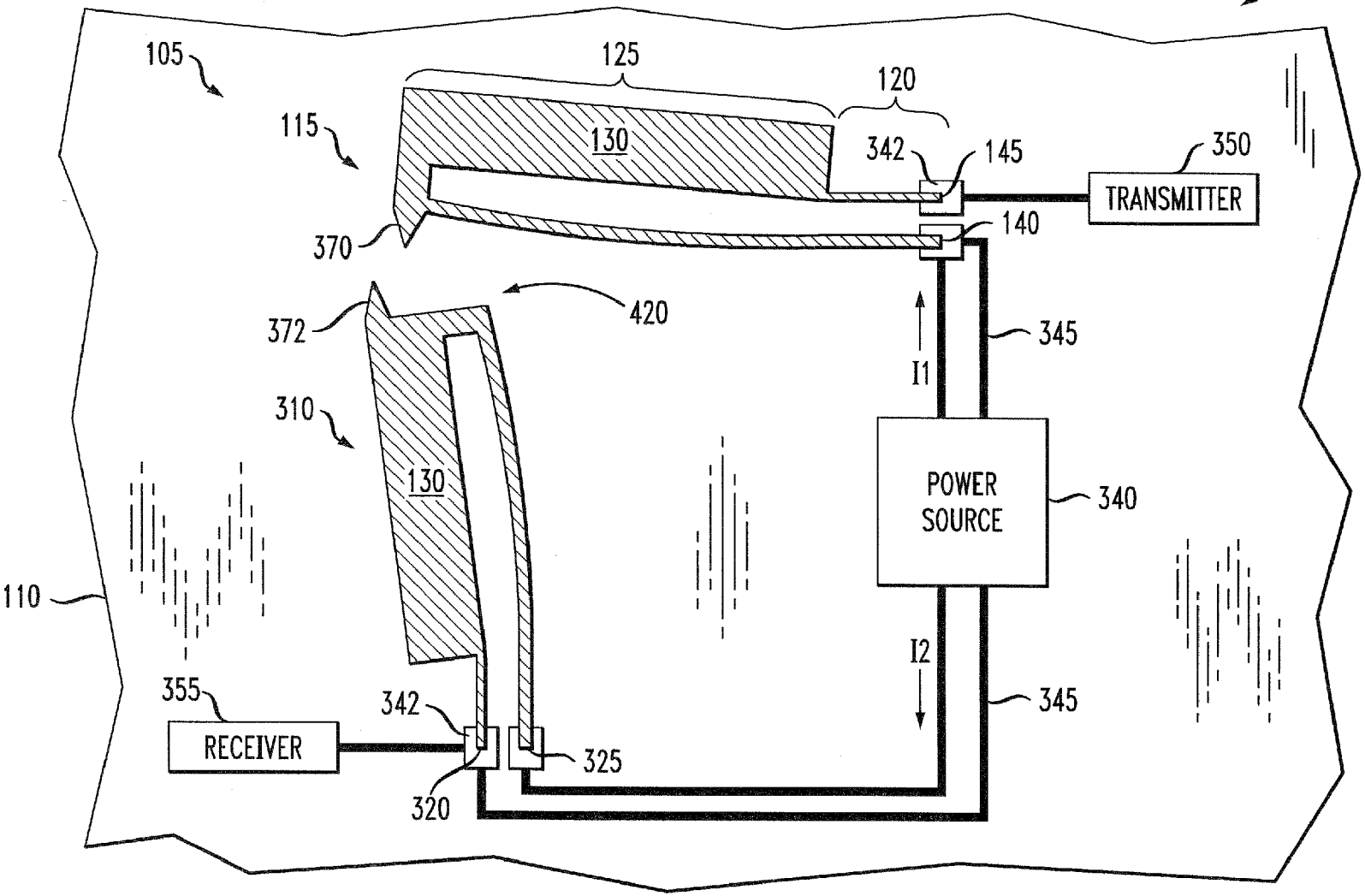
Figure 4C:
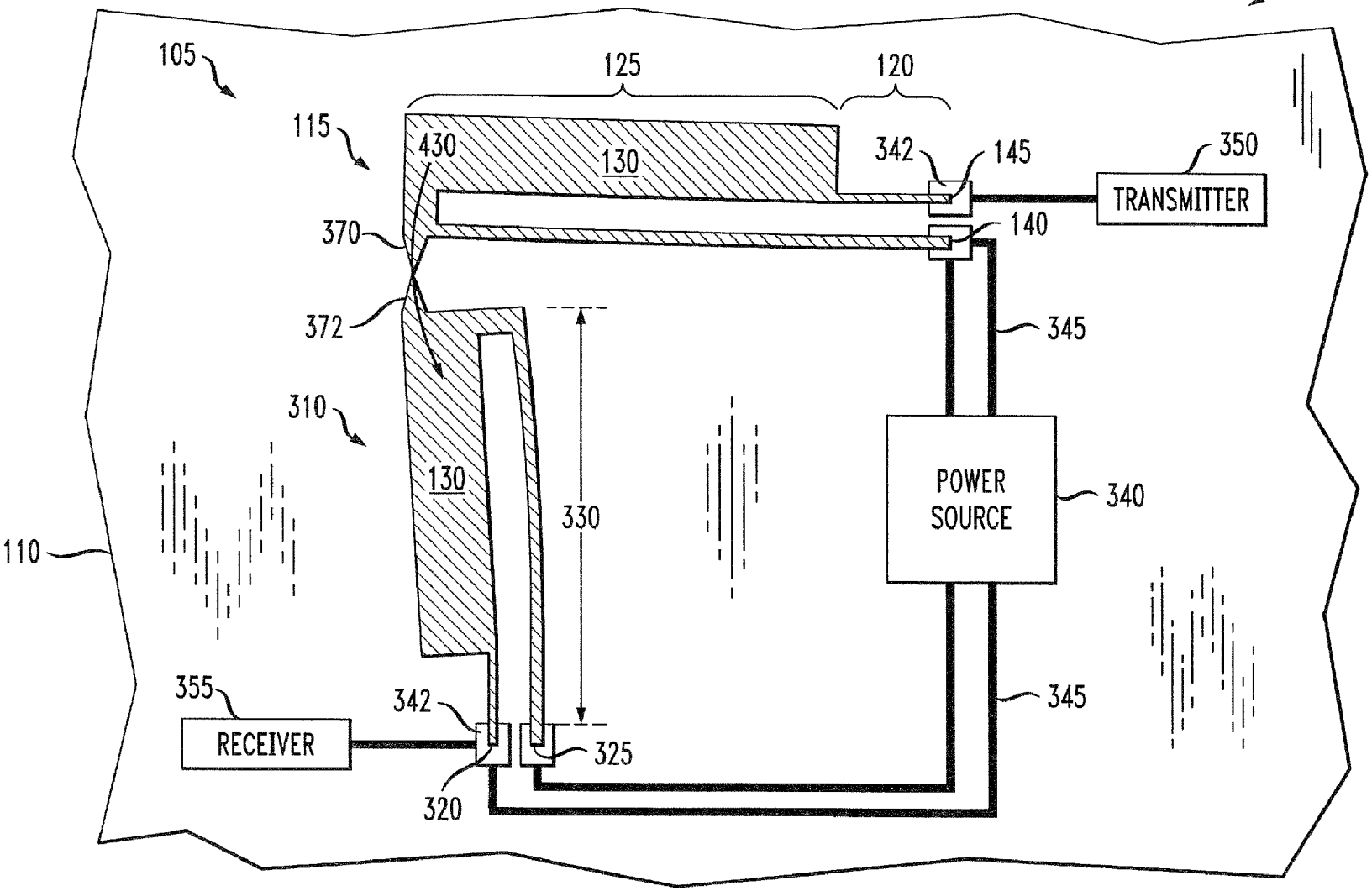

FIGS. 4A-4C shows the apparatus 100 depicted in FIG. 3 at different stages of actuating the MEMS device 105. FIG. 4A shows the MEMS device 105 after applying a current (I1) from the power source 340 to the structural element 115. The applied current is configured to actuate movement of the second part 125 of the structural element 115. E.g., a current passing through the structural element 115 can heat the structural element 115 causing thermal expansion of the second part 125, while the first part 120 remains rigidly fixed to the substrate 110. For instance, as illustrated in FIG. 4A, the second part 125 can be caused to move laterally in the same plane as the substrate 110, in direction 410.

FIG. 4B shows the MEMS device 105 after applying a second current (I2) to actuate movement of the second structural element 310 in a fashion similar to that described above for the structural element 115. E.g., the second structural element 310 is caused to move laterally in direction 420.

FIG. 4C shows the MEMS device 105 after the applied currents I1, I2 are turned off in a sequence (I1 off, then I2 off) that causes the projections 370, 372 of the structural element 115 and second structural element 310 to latch together in a stressed configuration. Latching the two structural elements 115, 310, in turn, thereby creates a conductive path between these two elements 115, 310 that does not require the continuous application of current I1 and I2. A signal 430 can then be transmitted via the transmitter 350 through one or both of the structural element 115 and second structural element 310 to the receiver 355. By turning on and off the applied currents I1, I2 in a pre-defined sequence (e.g., I2 on, I1 on, I2 off, I1 off), the structural element 115 and second structural element 310 can be de-latched from each other, thereby returning these two elements to the same state as shown in FIG. 3.

One skilled in the art would understand that the MEMS device 105 and its method of use could have different configurations to that depicted in FIGS. 1-4C. For instance, MEMS devices similar to that depicted in FIGS. 1-4C can be configured as microelectromechanical thermal actuators, relays or switches having structural elements configured to have one, two or a plurality of beams as appropriate for these devices. Some example configurations are presented in U.S. Pat. Nos. 6,407,478 and 7,036,312, which are incorporated by reference in their entirety. Regardless of the mechanical configuration of the apparatus 100 and the method of use, however, the MEMS device has at least one a structural element that includes the electroless alloy.

Another embodiment of the invention is a method of manufacturing an apparatus 500. FIGS. 5-10 present cross-sectional and plan views of an example embodiment of an apparatus 500 at selected stages of manufacture. Any of the above-discussed apparatuses and their component parts can be manufactured by the method. E.g., the method can include manufacturing a MEMS device 505 similar to that presented in FIGS. 1-4. The same reference numbers are used to depict similar features as presented in FIGS. 1 and 2.

Figure 5:
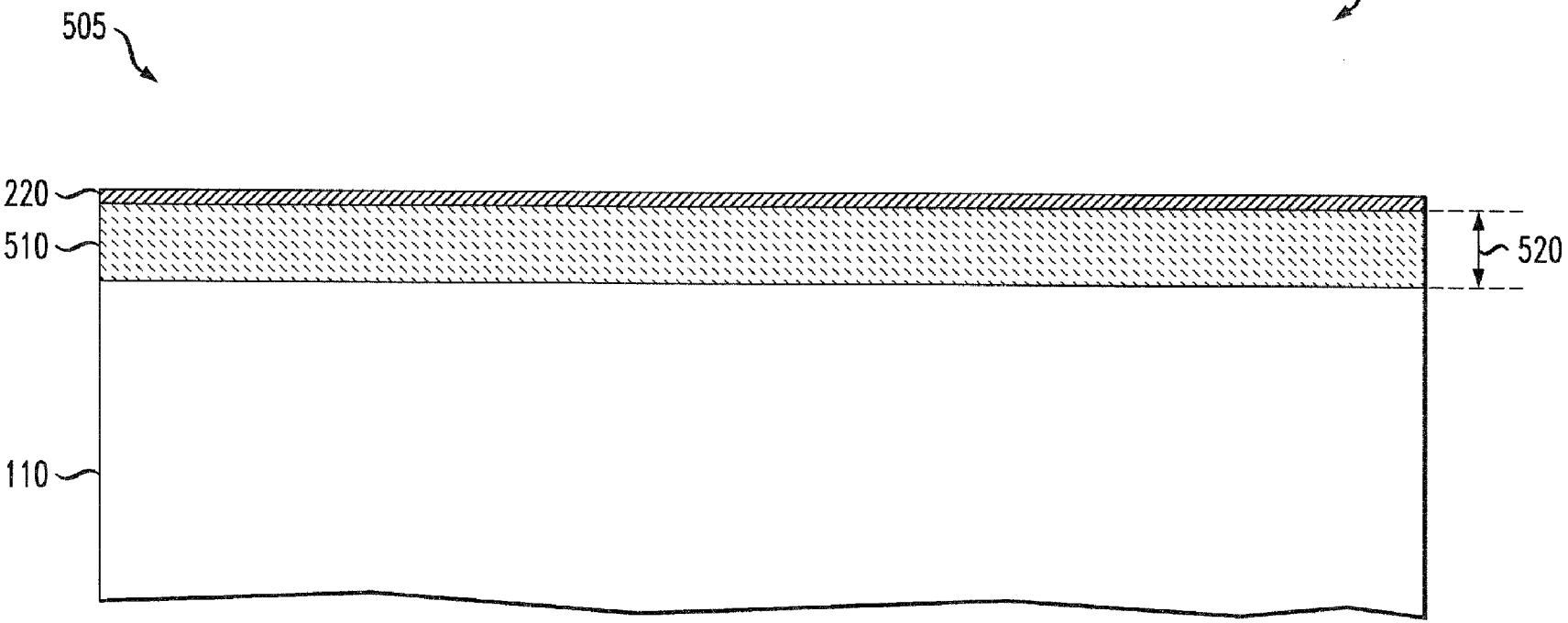
FIGS. 5-10 present cross-sectional and plan views of an example embodiment of an apparatus at selected stages of manufacture.

FIG. 5 presents a cross-sectional view (analogous to that shown in FIG. 2) of an apparatus 500 after forming a layer 510 on a substrate 110. The layer 510 is rigidly fixed to the underlying substrate 110. In some embodiments, the layer 510 comprises silicon oxide, and the substrate 110 comprises silicon. The layer 510 can be formed by any number of conventional techniques such as the thermal oxidation of a silicon wafer substrate 110. In some embodiments the layer 510 has a thickness 520 of about 1 to 10 microns. In other embodiments, the layer 510 can be composed of other materials, such as copper, that can be selectively removed without affecting a subsequently formed structural element that includes the electroless alloy or without affecting the substrate 110.

In some cases, it is advantageous to deposit a seed layer 220 on the layer 510 before commencing the electroless plating of nickel on the layer 510. FIG. 5 also shows the apparatus 500 after forming the optional seed layer 220 on the layer 510. Example seed layer materials include Ni, Ti, Cu, Au, Pd and Sn. The seed layer 220 can be formed by a non-electroless plating process, such as chemical or physical vapor deposition, or electroplating. Some embodiments of the seed layer 220 can be substantially free of phosphorus or boron, that is, have less than about 0.1 at % phosphorus or boron. In some preferred embodiments, the seed layer 220 comprises Ti thereby allowing such a seed layer 220 to be removed in the same step used to remove a silicon oxide layer 510. In other preferred embodiments, the seed layer 220 comprises Sn or Pd because these metals activate the rapid and uniform deposition of the electroless alloy on the layer 510 that comprising a dielectric material, such as silicon oxide.

Figure 6:
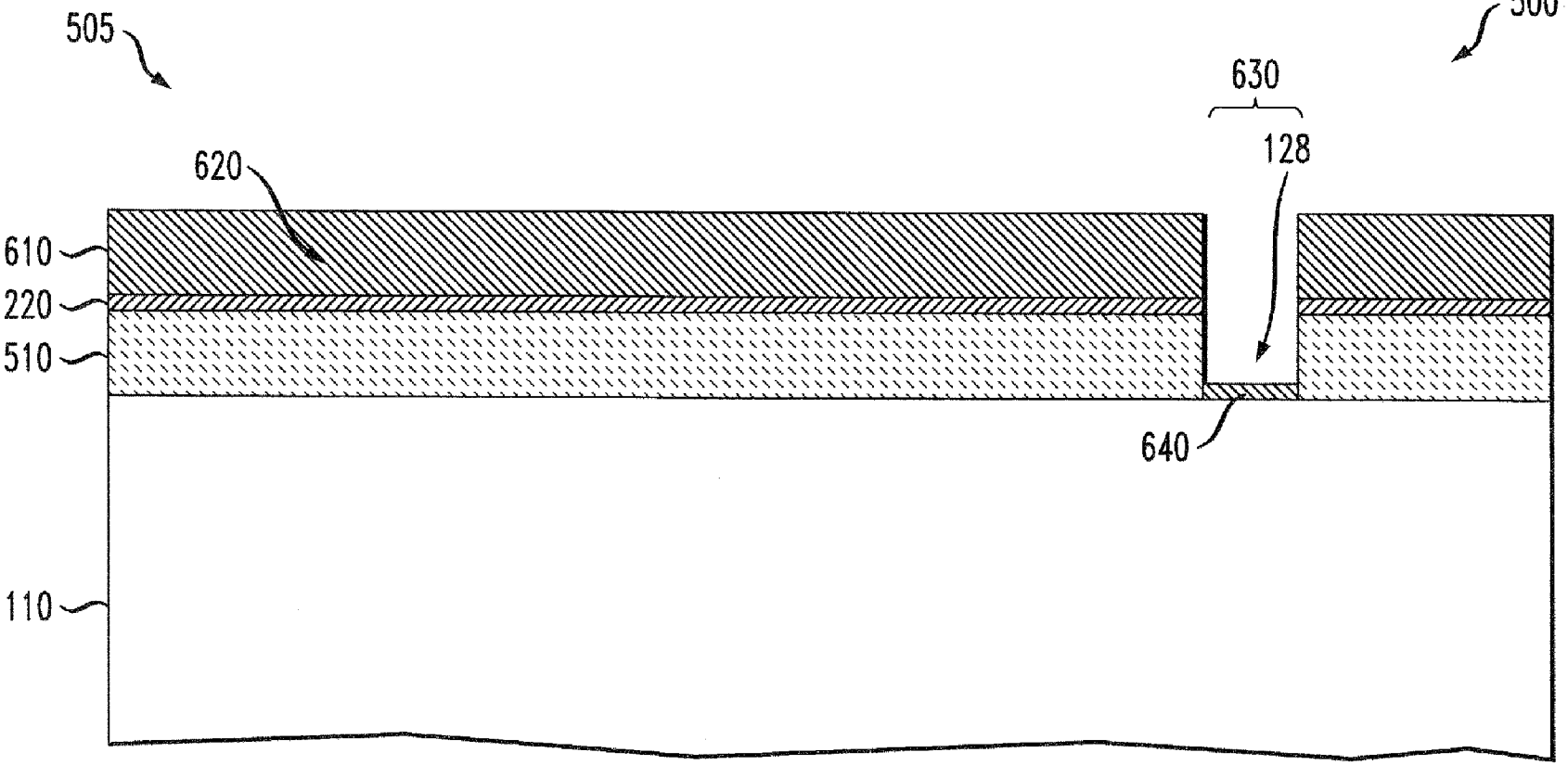

FIG. 6 shows the apparatus 500 of FIG. 5 after forming a mask 610 on a surface 620 of the layer 510 and after forming a window 630 in the mask 610. The mask 610 can comprise a conventional photo resist layer, and the second window 630 can also be formed by conventional photolithographic patterning processes.

FIG. 6 also shows the apparatus 500 after removing a portion of the layer 510, and seed layer 220 when present, that was exposed by the second window 630, to thereby expose a portion of the substrate's 110 surface 128. The process used to remove the portion of the layer 510 exposed by the second window 630 depends on the composition of the layer 510. E.g., when the layer 510 comprises silicon oxide, the exposed portion of the layer 510 can be removed using a reactive ion etching process. FIG. 6 also shows the apparatus 500 after forming a second layer 640 on the portion of the substrate's 110 surface 128 exposed by the second window 630. The second seed layer 640, in some embodiments, facilitates the electroless plating of the electroless alloy on the surface 128. The second seed layer 640 can be composed of the same or different material as the seed layer 220. In some cases, such as when the seed layer 220 will be removed from the final device structure, it is desirable to be a different material for the second layer 640. In such cases the second seed layer 640 can comprise a material that is not removed by the process used to remove the seed layer 220.

Figure 7:
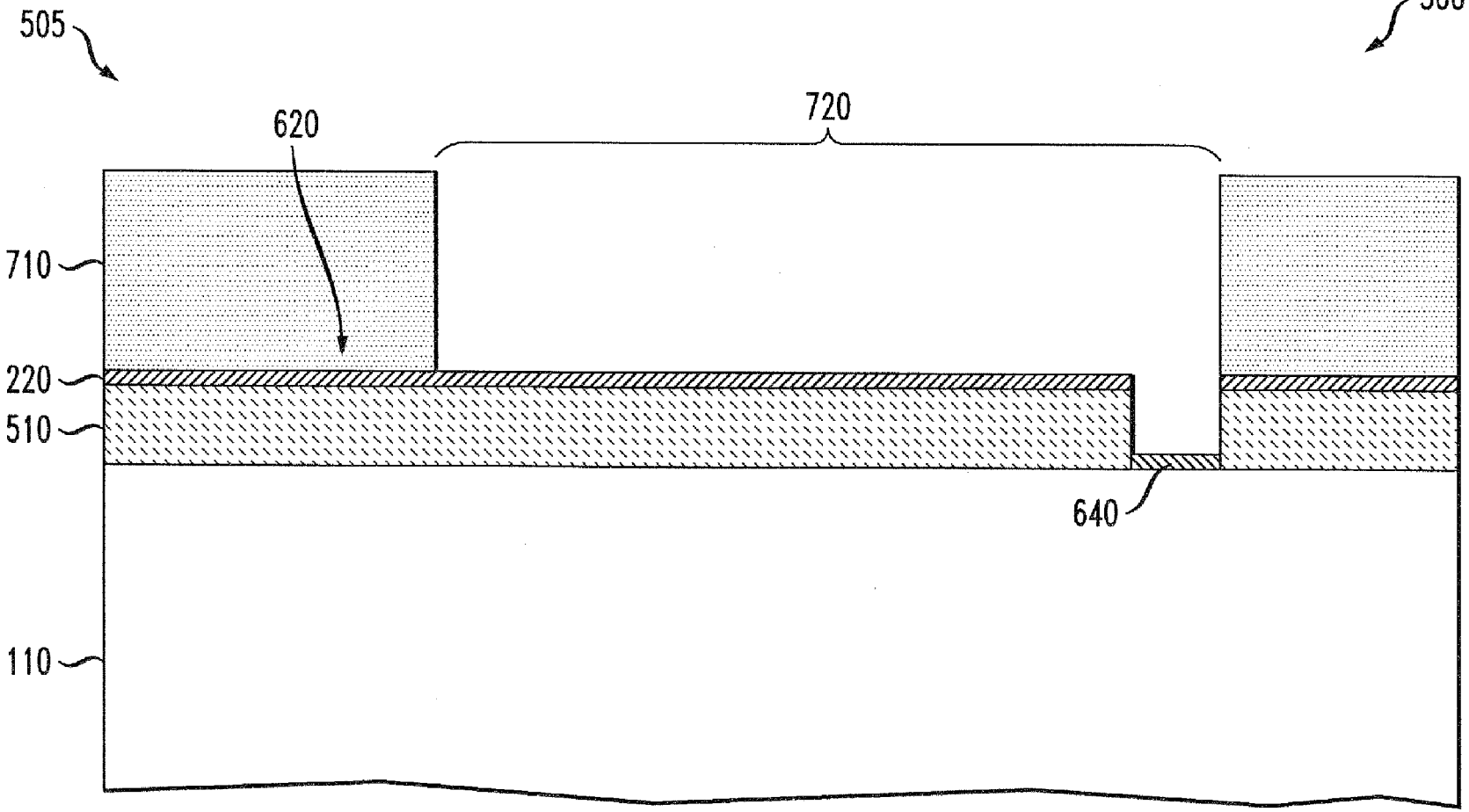

FIG. 7 shows the apparatus 500 of FIG. 6 after removing the mask 610, forming a second mask 710 on the surface 620 of the layer 510, the second mask 710 including a second window 720 that exposes a part of the layer's surface 620. The mask 610 (FIG. 6) can be removed using conventional techniques such as an organic solvent wash, such as acetone, methylethylketones, or hot chlorinated hydrocarbons, or by plasma ashing. In some embodiments, the second mask 710 comprises a photo resist layer and the second window 720 is formed using conventional photolithographic patterning processes. The second mask 710 can be patterned such that the second window 720 defines the shape of the structural element to be formed on the substrate 110. For instance, the second mask 710 can be patterned to form a second window 720 whose shape is analogous to the structural element 115 such as shown in FIG. 1 or 3. E.g., the second window 720 can define the first and second parallel beams 140, 145 of the structural element 115.

Figure 8:
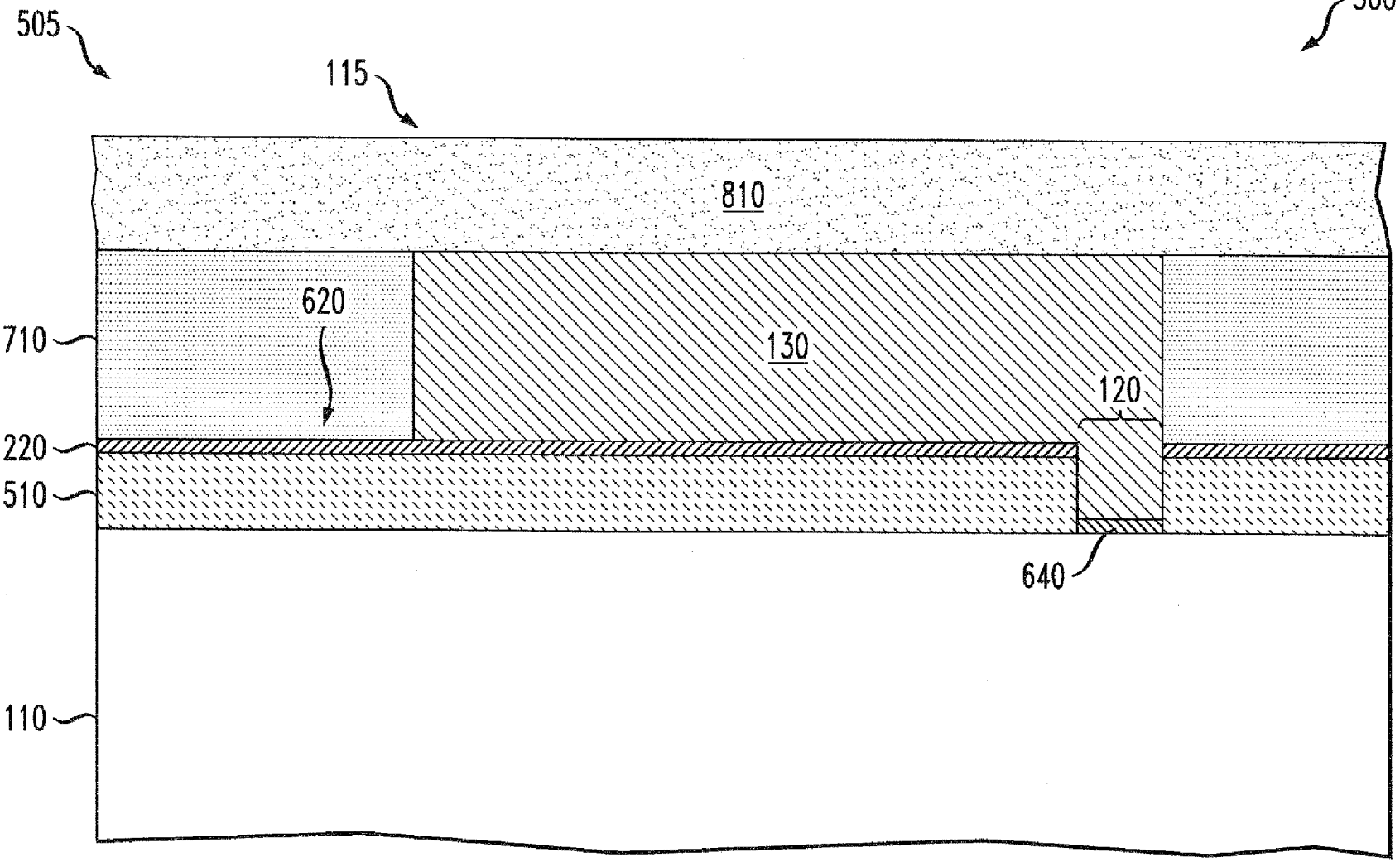

FIG. 8 shows the apparatus 500 of FIG. 6 after electroless plating of nickel onto the surface 620 of the layer 510 (or optional seed layer 220 when present), e.g., as part of forming a structural element 115. The structural element 115 includes nickel or cobalt and phosphorus or boron (e.g., the electroless alloy 130). Electroless plating as described herein means that no electrode is contacted to the layer 510, to the seed layer 220 or to the substrate 110, and no external current is passed through these structures, during formation of the structural element 115. Rather, nickel plating occurs by a nickel ion reduction reaction occurring in a solution on the layer 510 or seed layer 220.

In some embodiments, electroless plating includes contacting the surface 620 with a plating solution 810 containing nickel or cobalt (e.g., nickel or cobalt cations) and a reducing-agent. E.g., the entire apparatus 500 or just the MEMS device 505 can be placed inside the plating solution 810, or the plating solution 810 can be deposited on the surface 620. The plating solution 810 can be an aqueous solution that includes a nickel or cobalt salt and a reducing-agent that include a phosphorus- or boron-containing compound or compounds. E.g., the phosphorus-containing compound can comprise hypophosphite anions such that there is an about 9 at % or higher phosphorous content in the structural element 115, once formed. The boron-containing compound can comprise borohydrides or boranes such that there is an about 9 at % or higher boron content in the structural element 115, once formed. The nickel or cobalt salt can include a chloride, sulfate or other water-soluble salt of nickel or cobalt cations. Some embodiments of the reducing agent include sodium hypophosphite, sodium borohydride or dimethylamineborane. In some cases, the plating solution 810 is adjusted to a temperature ranging from 80 to 95° C. to facilatate the rapid formation (e.g., about 5 to 20 microns per hour) of the nickel or cobalt and phosphorus or boron-containing structural element 115.

As further illustrated in FIG. 8, the electroless plating of nickel or cobalt can include forming a part of the structural element 115 (e.g., first part 120) directly onto the portion of the substrate's 110 surface 128 exposed by the second window 630. For instance, in the embodiment depicted in FIG. 8, the structural element 115 is directly anchored to the substrate 110 via its first part 120. However, in other embodiments, the structural element 115 can be anchored to the substrate 110 via one or more intervening layers, including a portion of layer 510. After electroless plating the second mask 710 can be removed via a process similar to that described above for removing the first mask 610.

Figure 9:
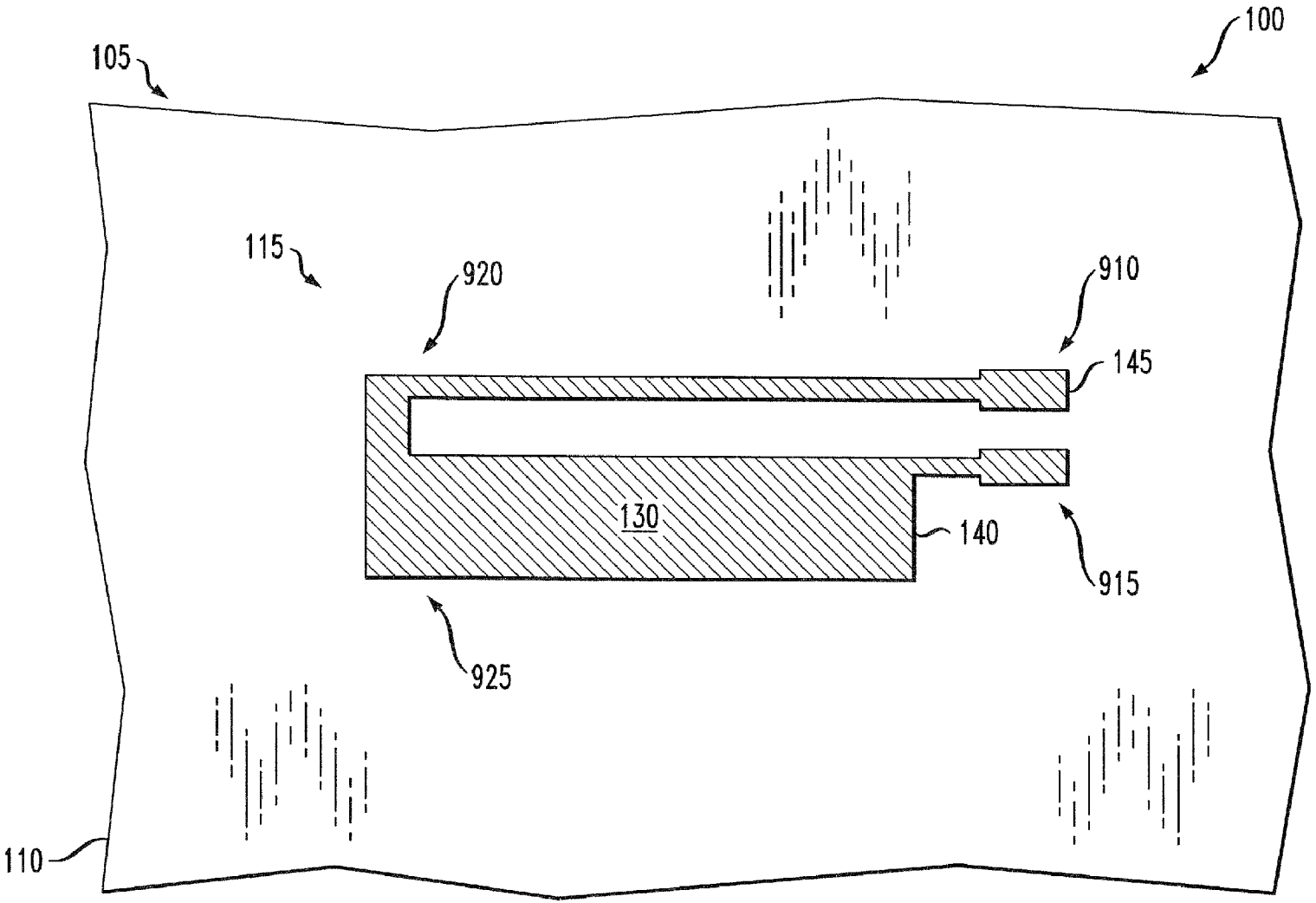

FIG. 9 shows a plan view of the apparatus 500 (similar to that depicted in FIG. 1) after the above-described electroless plating of the alloy 130. As illustrated in FIG. 9 forming the structural element 115 includes forming two parallel beams 140, 145. An end 910, 915 of each of the beams 140, 145, is anchored to the substrate 110, and opposite ends 920, 925 of beams 140, 145 are movable with respect to the substrate 110. As further illustrated in FIG. 9 the two parallel beams 140, 145 can be a single continuous piece of the electrolessly deposited Ni plating. In other cases, a third parallel beam can be connected to the structural element by a dielectric tether such as described in the above-cited U.S. Pat. Nos. 7,036,312 or 6,407,478.

Figure 10:
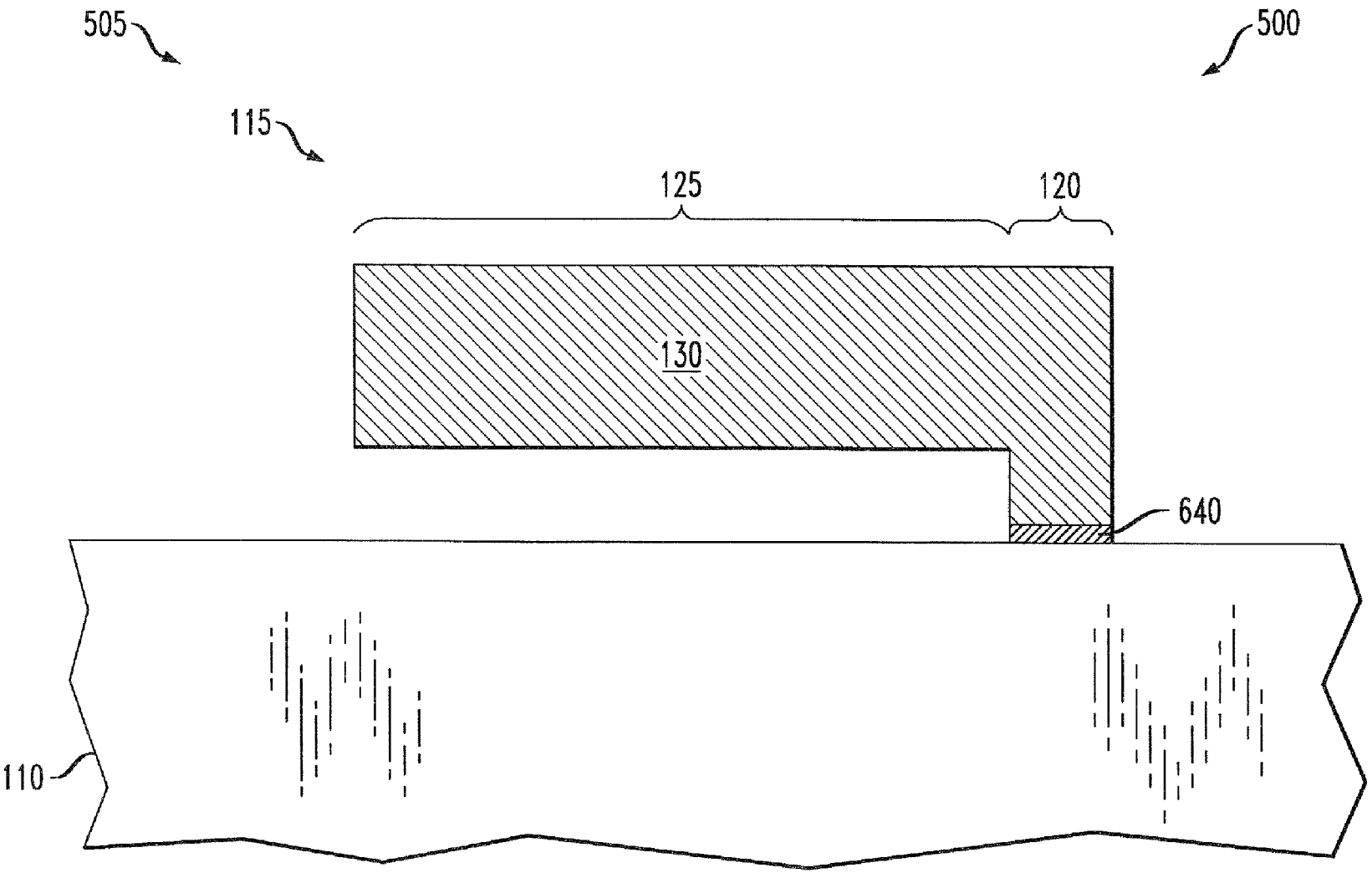

FIG. 10 shows the apparatus 500 of FIG. 8 after removing the second mask 710, and etching away a portion of the layer 510 such that a part of the structural element 115 (e.g., second part 125) is able to move with respect to the substrate 110. In some embodiments, such as shown in FIG. 8, etching away a portion of the layer 510 includes removing substantially all of the layer 510. In such cases, the layer 510 is a sacrificial layer. In other cases, a portion of the layer 510 is retained, e.g., as an intervening layer to anchor the structural element 115 to the substrate 110.

The etching process used to remove the layer 510 depends on the composition of the layer 510. E.g., when the layer 510 comprises silicon oxide, the etching process can include exposing the layer 510 to hydrofluoric acid. In some cases, the process to etch away all or a portion of the layer 510 further includes etching away the seed layer 220. E.g., when the seed layer 220 comprises titanium, a hydrofluoric acid etch can removed both the layer 510 and seed layer 220, such as illustrated in FIG. 10. In other cases, however, a separate etch process could be used to remove the seed layer 220, or, the seed layer can be left on, and hence become part of, the structural element 115.

There can be multiple additional steps to complete the manufacture of the apparatus 500 shown in FIGS. 8 and 9. For instance referring again to FIG. 3, where MEMS device 105 is configured as a microelectromechanical thermal relay, the method can include forming the MEMS device which includes forming the structural element 115 and a second structural element 310 as described above in the context of FIGS. 5-10. The method can also include electrically coupling a power source 340, a transmitter 350 and a receiver 355 to one or both the structural element 115, and second structural element 310. For instance, conventional techniques can be used to form metal (e.g., W, Au or Cu) contacts 342 and lines 345 on the substrate 110 to thereby interconnect the structural element 115 (and second structural element 310) with the power source 340, the transmitter 350 and the receiver 355.

Although the embodiments have been described in detail, those of ordinary skill in the art should understand that they could make various changes, substitutions and alterations herein without departing from the scope of the invention.

What is claimed is:

1. An apparatus, comprising:

a substrate having a surface; and a MEMS device including a structural element having a first part that is rigidly fixed to said surface, and a second part that is movable with respect to said substrate, wherein said structural element is a separately moveable monolayer of nickel or cobalt alloyed with phosphorus or boron and having a substantially amorphous structure, and said first part and said second part are different portions of a single continuous piece of said monolayer.

2. The apparatus of claim 1, wherein said nickel or cobalt alloy has a yield point that is within about 55 percent of said nickel or cobalt alloy's ultimate tensile strength.

3. The apparatus of claim 1, wherein a surface of said structural element further comprises a metal seed layer thereon, wherein said seed layer is free of phosphorus or boron.

4. The apparatus of claim 1, wherein said structural element consists essentially of said nickel or said cobalt alloyed with said phosphorus or said boron.

5. The apparatus of claim 1, wherein said structural element is composed of at least about 99 wt % said nickel or said cobalt alloyed with said phosphorus or said boron.

6. The apparatus of claim 1, wherein said second part is configured to reversibly deform when an actuating current is applied through said structural element.

7. The apparatus of claim 1, wherein said second part includes a first beam and a second beam, wherein said first beam is parallel to said second beam and said second beam is configured to thermally expand to a greater extent than said first beam when an actuating current is applied through said structural element.

8. The apparatus of claim 7, wherein a width of said first beam is about two times or greater than a width said second beam.

9. The apparatus of claim 1, wherein said second part of said structural element includes a flexible beam.

10. The apparatus of claim 1, wherein said second part of said structural element includes a first flexible beam and a second flexible beam.

11. The apparatus of claim 1, wherein said structural element forms one contact of an electrical switch.

12. An apparatus comprising:

a substrate having a surface; and a MEMS device including a structural element having a first part that is rigidly fixed to said surface, and a second part that is movable with respect to said substrate, wherein said first part and said second part are different portions of a single continuous piece formed of nickel or cobalt alloyed with phosphorus or boron and having a substantially amorphous structure, and further including:

a voltage source electrically coupled to said structural element;

a transmitter and a receiver electrically coupled to a second structural element, wherein said transmitter is configured to transmit a signal to said receiver through one or both of said structural element and said second structural element when one or both of said structural element and said second structural element are actuated to contact each other, and wherein said MEMS device is configured as a microelectromechanical thermal relay and further includes said second structural element on said substrate and adjacent to, but electrically isolated from, said structural element when said MEMS device is not actuated.

* * * * *